United States Patent [19]

Meier et al.

[11] Patent Number: 4,705,703

[45] Date of Patent: Nov. 10, 1987

[54] METHOD OF PREVENTING CORROSION OF UNCOATED ALUMINUM SHEET OR BEVERAGE CANS IN A BREWERY PASTEURIZER WATER SYSTEM

[75] Inventors: Daniel A. Meier, Naperville; Michael J. Groshans, Lombard, both of Ill.

[73] Assignee: Nalco Chemical Company, Naperville, Ill.

[21] Appl. No.: 880,264

[22] Filed: Jun. 30, 1986

[51] Int. Cl.[4] ..... C23F 11/04

[52] U.S. Cl. ..... 427/239; 252/389.52; 252/389.2; 106/14.12; 427/435

[58] Field of Search ..... 148/6.15 Z; 252/389.52, 252/389.2; 106/14.12; 427/435, 239

[56] References Cited

U.S. PATENT DOCUMENTS 3,837,928 9/1974 Morrison ..... 148/6.15 Z
3,941,562 3/1976 Hollingshad ..... 252/389.2
4,052,232 10/1977 Brock ..... 148/6.15 Z
4,297,237 10/1981 Boffardi ..... 252/389.2

FOREIGN PATENT DOCUMENTS 1324460 7/1973 United Kingdom ..... 148/6.15 Z

*Primary Examiner*—Sam Silverberg
*Attorney, Agent, or Firm*—John G. Premo; Donald G. Epple; Anthony L. Cupoli

[57] ABSTRACT

A method for eliminating or reducing dome staining during the pasteurization of aluminum beverage cans involves the addition of zinc, orthophosphate, a zinc stabilizing polymer and, optionally, organophosphonate corrosion inhibitors and/or other known corrosion inhibitors. The zinc stabilizing polymer contains at least 25 weight percent acrylic acid, methacrylic acid, their water soluble salts, or admixtures thereof. These polymers may be homopolymers, copolymers, terpolymers, and above.

6 Claims, No Drawings

METHOD OF PREVENTING CORROSION OF UNCOATED ALUMINUM SHEET OR BEVERAGE CANS IN A BREWERY PASTEURIZER WATER SYSTEM

INTRODUCTION

Aluminum beverage can manufacturers have routinely used various organic and inorganic chemicals to prevent staining of aluminum alloy surfaces during the processing of aluminum alloy sheet to form aluminum cans and during the pasteurization of these formed aluminum alloy cans after processing which fills those cans with liquid beverages and caps them for shipment to the consumer. The chemicals used to prevent staining of these aluminum alloy sheet surfaces as well as to prevent the staining and corrosion of these aluminum alloys after formulation into aluminum cans have for the most part been referred to as conversion coating chemicals. These conversion coatings prevent staining and corrosion of the aluminum alloys used in pasteurization of these aluminum containers. These conversion coating chemicals prevent what is referred to in the industry as aluminum can dome staining.

These conversion coating chemicals, however, are presenting to the aluminum can manufacturer and the aluminum can and beverage processor certain environmental problems. New environmental restrictions have caused these aluminum can beverage manufacturers to limit the discharge of various conversion coating chemicals.

In fact some breweries using aluminum cans to hold their product are now specifying that the conversion coatings previously used in the industry not be placed on the surface of the aluminum can. Since these coatings cannot be used, the degree of dome staining drastically increases. Dome staining creates an adverse visual effect which causes poor consumer acceptance of the product, and it would be an advance in the art if one could discover a process and a formulation for preventing dome staining without simultaneously presenting environmental problems to the aluminum beverage can manufacturer.

Therefore, it is an object of this invention to provide a corrosion preventing formula for use in preventing corrosion of aluminum alloy sheet by surface coating and treating said aluminum alloy sheet with an effective amount of a formula which does not present major environmental hazards.

It is also an object of this invention to provide a formula which functions to minimize and eliminate dome staining, which is the darkening of aluminum cans believed to be due to corrosion of the surfaces of aluminum alloy causing other metals and/or their oxides to bloom to the surface of the aluminum, such metals including iron, manganese, other transition metals or alloying metals, admixtures thereof, and the like.

It is also an object of the invention to provide the same kind of corrosion control which may be used in aqueous systems used to pasteurize aluminum cans at concentrations considerably below one percent and preferably below 500 ppm, total weight, of the aqueous system used to pasteurize the cans and to prevent dome staining and corrosion of the aluminum alloys used in the manufacture of aluminum beverage cans.

It is also an object of this invention to eliminate the need for using environmentally hazardous conversion coating chemicals and separate chemical treatments for the prevention of dome staining.

It is also an object of this invention to protect from corrosion effects not only the aluminum alloy can surface from the dome staining effect, but also to protect the equipment used in the pasteurizing of these cans from corrosion and scaling caused by deposit formation where these deposits are corrosion products containing various metals such as aluminum, hardness metals such as magnesium and calcium, iron, manganese, zinc, and the like, and their water insoluble salts, such as oxides, hydroxides, carbonates, and the like.

OUR INVENTION

Our invention is a method of preventing corrosion of aluminum alloy sheet used in aluminum beverage containers and cans and a method of preventing dome staining of aluminum beverage cans by exposing the surface of said aluminum alloy and/or aluminum beverage cans during the pasteurization thereof to an effective amount, for the purpose of preventing dome staining, of a corrosion preventing formula having the ingredients:

(a) at least 1 ppm, as zinc, of a water soluble zinc salt, (b) at least 1 ppm, as orthophosphate anion, of a water soluble inorganic orthophosphate source, (c) at least 1 ppm of a water soluble zinc ion stabilizing polymer, having a molecular weight ranging between about 1,000–50,000 and containing at least 25 weight percent of acrylic acid, (meth)acrylic acid, their water soluble salts, and mixtures thereof, and at least 10 weight percent of at least one other vinylic monomer, or mixtures of vinylic monomers, chosen from the group consisting of:

[acrylamide, (meth)acrylamide, methylacrylate, methyl(meth)acrylate, ethylacrylate, ethyl(meth)acrylate, N-methyl acrylamide, N-methyl (meth)acrylamide, N-ethyl acrylamide, N-ethyl (meth)acrylamide, N-tertiary-butyl acrylamide, N-tertiary-butyl (meth)acrylamide, N-dimethyl acrylamide, N-dimethyl (meth)acrylamide, N-diethyl acrylamide, N-diethyl(meth)acrylamide, 2-acrylamido-methylpropylsulfonic acid, 2-methacrylamido-methylpropylsulfonic acid, or their water soluble salts, N-alkylated (meth)acrylamide represented by the formula:

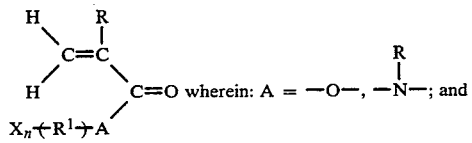

wherein:

R, in each occurrence, is chosen from the group consisting of hydrogen, methyl, and ethyl groups;

$R^1$ is a hydrocarbon bridging group containing from 1–16 carbon atoms and chosen from multi-valent hydrocarbonaceous bridging groups which are linear alkyl, branched alkyl, cyclic, aryl, alkaryl, arylalkyl groups, and mixtures thereof;

X is a functional group chosen from $—SO_3M$, $—NR_2$, $—NR_3Y$, $(PO_3M)$, $(O—CH_2CHRO)_m R$, and mixtures thereof; and n is from 1–6; m is from 0–30; M is chosen at each occurrence from the group hydrogen, sodium, potasium, ammonium and mixtures thereof; Y is an anion from the group chloride, bromide, iodide, methylsulfate, and mixtures thereof];

(d) a water soluble organic phosphonate, from 0–1,500 ppm; and (e) water, the remainder;

and wherein the corrosion preventing formula has a pH ranging from about 5.0–8.5.

The method of preventing corrosion on the aluminum can alloy surfaces, referred to as prevention of dome staining, is accomplished by contacting these aluminum alloy sheet surfaces with an aqueous solution as described above at temperatures ranging from ambient temperatures up to about 175° F., and wherein the corrosion preventing formula has a pH ranging between about 5.0–8.5, preferably between about 6.0–8.0, and most preferably between about 7.0–8.0.

Control of pH seems critical to prevention of dome staining, particularly during the pasteurization process. No inhibitor formulation has yet been experimentally demonstrated which prevents dome staining at pH's above 9.0, while most dome staining inhibitors described above work well to prevent dome staining and aluminum alloy sheet corrosion when the pH ranges between about 6.0–8.0.

THE ZINC SOURCE

The zinc source appearing in the formulation is normally obtained from any water soluble zinc salt such as zinc chloride, zinc nitrate, zinc sulfate, zinc acetate, and the like. The zinc salt chosen must only be soluble at concentrations useful in the practice of this invention, which concentrations must exceed about 1 ppm, as zinc, based on the total weight of the aqueous treatment. Preferably, the zinc salt will be present at concentrations ranging from about 2.0–200 ppm, as zinc; and most preferably, at zinc concentrations ranging between about 2.5–150 ppm, as zinc.

THE ORTHOPHOSPHATE SOURCE

The orthophosphate source may be present as any water soluble orthophosphate salt, or even as the free acid of orthophosphoric acid. Such orthophosphate salts can include the salts of alkali metals, ammonium, amine, or quaternary ammonium salts, zinc salts, and the like. Preferably, the orthophosphate ion source is orthophosphoric acid, or the sodium, potassium, zinc or ammonium salts thereof. Orthophosphate ions are present in the treatment formulation at a concentration of at least 1 ppm, preferably from 2–500 ppm, more preferably from 5.0–400 ppm, and most preferably between about 10–350 ppm, calculated as $PO_{-3}^{4}$ (or as the orthophosphate anion).

THE ORGANOPHOSPHONATE SOURCE

The organophosphonate source is any water soluble organophosphonate compound, such as HEDP*, PBTC, AMP*, and similar Dequest**** materials, and the like, or mixtures thereof. This organophosphonate is optionally present at concentrations ranging from about 0 to 1500 ppm, calculated on a weight basis of the organophosphonate present, i.e., if HEDP is chosen as the organophosphonate, then the concentration of HEDP would range, optionally, between about 0–1500 ppm.

* HEDP=Hydroxyethylidene diphosphonic acid.

** PBTC=Phosphonobutane tricarboxylic acid.

*** AMP=Aminotrimethylene phosphonic acid.

**** Dequest is a registered trademark of Monsanto Chemical Co.

Preferably, the organophosphonate would optionally be present at a concentration of from 0–1000 ppm, and most preferably, from 1–750 ppm. If the zinc stabilizing polymers are not present in the formulations, then the organophosphonate chosen shoule be present at a concentration ranging from 10–1500 ppm, preferably from 20–1000 ppm, and most preferably from 25–750 ppm, based on the weight of the organophosphonate or mixtures thereof, chosen to be included in the dome staining treatment.

THE ZINC STABILIZING POLYMER

The zinc stabilizing polymer is not an optional ingredient of the dome staining aqueous treatment formulation. The zinc stabilizing polymer inhibits the precipitation of basic zinc salts, such as the oxides, hydroxides, carbonates and the like, from aqueous media as the alkalinity or pH of that aqueous media increases. This inhibition of zinc precipitation is known in the art, and polymers which have this characteristic are referred to herein as zinc stabilizing polymers. The zinc stabilizing polymers allow corrosion protection at pH above 5.0, preferably above 7.0.

The zinc stabilizing polymers of this invention have a molecular weight ranging between about 1000 to 50,000, preferably between about 2000 to 35,000, and most preferably between about 2500 to 25,000, as the weight average molecular weight. The polymers contain at least 25 mole percent of acrylic acid, methacrylic acid, or admixtures thereof, or their water soluble salts. The mixture of these acids, or each singly, shall be referred to herein as (meth)acrylic acids. The (meth)acrylic acids may be present in the polymers as the free acid or as the water soluble salt, in any admixture of same. For example, a portion of the carboxylic acid functionality present in the (meth) acrylic acids may be free acids, a portion may be as the sodium, potassium, ammonium or zinc salt, or admixtures of any of these—or any other acid salt species which would not interfere with water solubility or zinc stabilizing efficacy.

In addition, the zinc stabilizing polymer also contains at least 10 mole percent of at least one other vinylic monomer, or mixture of vinylic monomers, chosen from the group consisting of acrylamide, methacrylamide, methylacrylate, methyl methacrylate, ethyl acrylate, ethyl methacrylate, N-methyl acrylamide, N-methyl methacrylamide, N-tertiary butyl acrylamide, N-tertiary butyl methacrylamide, N,N-dimethylacrylamide, N,N-dimethyl acrylamide, N,N-methyl, ethyl acrylamide, N,N-dimethyl methacrylamide, N,N-diethyl methacrylamide, N,N-methyl, ethyl methacrylamide, 2-acrylamido-ethylpropysulfonic acid or its water soluble salts, and N-substituted acrylamide or N-substituted methacrylamide monomers chosen from a group of monomers represented by the formula:

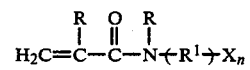

wherein:

R, at each occurrence, is chosen from the group —H, —$CH_3$, and —$C_2H_5$;

$R^1$ is a multivalent hydrocarbonaceous bridging group containing from 1 to 12 carbon atoms, and which may be linear or branched alkyl, cyclic, aryl, alkaryl, arylalkyl, and mixtures thereof;

X is a functional group chosen from the group consisting of —$SO_3M$, —$NR_2$, —$NR_3Y$, —$PO_3M_2$, —O-(-$CH_2CHRO$-)$_m$-R, and mixtures thereof; and wherein:

n is between 1–6;

M is, independently, at each occurrence from H, Na, K, $NR_4$, and mixtures thereof;

m is from 0 to 30; and

Y is Cl, Br, I, $SO_4CH_3$, and mixtures thereof.

Preferably, the zinc stabilizing polymers are copolymers and/or terpolymers of acrylic acid, methacrylic acid, or their water soluble salts with the vinyl monomers listed above. Most preferably, the zinc stabilizing polymers are copolymers of (meth)acrylic acid, or its water soluble salts, with the methyl or ethyl esters of acrylic acid or methacrylic acid; copolymers of acrylic acid and methacrylic acid; terpolymers with acrylic acid, methacrylic acid, and N-substituted acrylamides or N-substituted methacrylamides, and copolymers or terpolymers of acrylic acid, methacrylic acid, acrylamide, methacrylamide and N-substituted acrylamides or methacrylamides in which the N-substitution is a branched alkyl substituent group, such as N-tertiary butyl acrylamide.

When the N-substituted group on the acrylamide or methacrylamide has another hetero atom functional group contained thereon, it is preferred that that hetero atom functional group be chosen from —O-(-$CH_2$-$CHRO$-)$_m$-R, —$SO_3M$, and —$NR_3$ or —$NR_4Y$, or mixtures thereof, wherein m ranges from 0–30, and R, M, and Y have the meanings above.

The most preferred zinc stabilizing polymers are chosen from the group consisting of (1) copolymers of acrylic acid, or its salts, and methyl or ethyl acrylate esters, wherein the copolymer contains at least 75 mole percent acrylic acid, or its water soluble salt; (2) terpolymers of acrylic acid, methacrylic acid, and N-t-butyl acrylamide, wherein the mole percent of N-t-butyl acrylamide is from 2 to 40 mole percent; and (3) copolymers or terpolymers or acrylic acid, methacrylic acid, acrylamide and methacrylamide and N-substituted acrylamides represented by the formula:

$$H_2C{=}\overset{R}{\overset{|}{C}}{-}\overset{O}{\overset{\|}{C}}{-}NH\text{-}(R^1)\text{-}X_n$$

wherein:

R is H or $CH_3$; and $R^1$ is a hydrocarbonaceous bridging group containing from 2–8 carbon atoms which may be linear or branched alkyl, aryl, alkaryl or arylalkyl; and x is —$SO_3M$, —O-(-$CH_2CHRO$-)$_m$-R, $NR_4Y$, and mixtures thereof; and n is from 1–4, and m is from 0–20; and Y is Cl, Br, and methyl sulfate, or mixtures thereof; and M is H, Na, K, ammonium, and mixtures thereof.

A particularly preferred monomer having the above description is:

$$H_2C{=}CH\overset{O}{\overset{\|}{C}}NHCH_2CH_2SO_3M$$

wherein:

M is as described above.

THE DOME-STAINING TREATING FORMULATION

The formulation must contain zinc, orthophosphate, and the zinc stabilizing polymer in an aqueous solution. The aqueous solution may also contain, optionally, the organophosphonates and may also contain other ingredients which are known corrosion inhibitors such as tolyltriazole and other such azole compounds.

Preferably the formulation contains both the organophosphonate and the zinc stabilizing polymers, in addition to the water soluble zinc salts and orthophosphate ion source.

The pH of the formulation should range between about 5.0 and 8.5, preferably between about 6.0 and 8.0.

The treating solution is washed over, about, and around the aluminum sheet being formed into cans and over, about and around the aluminum cans during the pasteurization process. During this treatment, the temperatures of the treating solution and the aluminum surfaces may range from ambient room temperature to elevated temperatures up to about 190° F. Preferably the treatment temperatures range from about 70° F. to about 175°F., and most preferably between about 75° F. to about 160° F.

To illustrate the advantages of our new dome staining prevention formulation, the following tests are presented.

These test results were generated by exposing raw aluminum cans to various aqueous solutions containing the formulation listed below, under pasteurizing conditions at temperatures between about 75° F. to about 150° F. After drying and exposure to air for 2 to 48 hours, the cans were examined visually, and the results were rated from 1 to 4, with 1 being heavily stained and 4 being no visually discernible stain.

The Blank was water, with no treatment. The tests were run with pH controls ranging from 7.0 to 9.0. The results are presented in Table 1.

TABLE I

| | Dome Staining Experiments - Rating | | | | |
|---|---|---|---|---|---|
| | Treatment/pH | 7.0 | 7.5 | 8.0 | 9.0 |
| 1. | Blank | | 1 | 1 | 1 |
| 2. | Stabilized Phosphate alone* | | | | |
| | @ 50 ppm | 3 | | 2 | 1 |
| | @ 100 ppm | 3 | | 2 | 1 |
| | @ 150 ppm | 4 | | 2 | 1 |
| 3. | Zinc Program | | | | |
| | a. 50 ppm "A" 25 ppm "B" | 4 | | 3 | |
| | b. 50 ppm "A" 50 ppm "B" | 4 | | 2 | |
| | c. 100 ppm "A" 50 ppm "B" | 4 | — | 3 | 1 |
| | d. 150 ppm "A" 50 ppm "B" | — | 4 | 4 | 1 |
| | e. 200 ppm "A" 75 ppm "B" | | | 4 | 1 |
| 4. | Zinc Phosphate 23 ppm "C" | 4 | — | 3 | — |
| 5. | Molybdenum Phosphate 100 ppm "D" | 4 | 4 | 3 | 1 |
| 6. | Commercial Conversion Coating Formulation | — | — | 4 | 4 |
| 7. | 150 ppm "A" | 4 | — | 3 | 2 |
| 8. | 75 ppm "B" | 4 | — | 3 | — |
| 9. | 75 ppm "E" | 4 | — | 2 | — |
| 10. | 75 ppm "F" | 4 | — | 2 | — |
| 11. | 20 ppm "G" | 4 | — | 3 | 2 |
| 12. | 75 ppm "H" | 4 | — | 3 | — |
| 13. | 75 ppm "E" | — | — | 4 | — |

TABLE I-continued

| | Dome Staining Experiments - Rating | | | | |
|---|---|---|---|---|---|
| | Treatment/pH | 7.0 | 7.5 | 8.0 | 9.0 |
| | +9 ppm "I" | | | | |
| 14. | 75 ppm "F" +9 ppm "I" | — | — | 3 | — |
| 15. | 75 ppm "H" +9 ppm "I" | — | — | 3 | — |
| 16. | 9 ppm "I" | — | — | 2 | — |
| 17. | 50 ppm "J" | — | — | 2 | — |
| 18. | 50 ppm "J" +9 ppm "I" | — | — | 3 | — |

*Stabilized Phosphate Program formula:
3.9 weight % of plant softened water
11.0 weight % of 85% solution of phosphoric acid
3.0 weight % of 60% solution of HEDP
44.0 weight % of 45% solution of potassium hydroxide
12.9 weight % of 47% solution of Goodrite KXP-70
0.8 weight % of Diacid 1550
17.4 weight % of 60% solution of tetrapotassium pyrophosphate
7.0 weight % of 50% solution of sodium tolyltriazole In the above Table I, the formulas "A" through "H" are identified as follows:

"A" 70–80%, by weight, soft water;
10–12%, by weight, phosphoric acid; 75 wt. % in $H_2O$;
5–7%, by weight, zinc chloride; 67 wt. % in $H_2$;
7–9%, by weight, Bayhibit AM*.

"B" 55–65%, by weight, soft water;
8–12%, by weight, NaOH; 50 wt. % in water;
5.5–7.7%, by weight, Cobratec TT50S**;
0.1–1.5%, by weight, Diacid 1550***;
15–25%, by weight, (Polymer G): terpolymer of acrylic acid; methacrylic acid; N—t-butyl acrylamide; 60; 20; 20 mole percent.

"C" 40–45%, by weight, soft water;
12.5–17.5%, by weight, citric acid, anhydrous;
30–35%, by weight, phosphoric acid, 85% in water;
8–10%, by weight, zinc oxide.

"D" 70–75%, by weight, water;
10–12%, by weight, NaOH; 50 wt. % in $H_2O$;
4–6%, by weight, Borax-Granular;
0.5–1.5%, by weight, Cobratec TT50S;
4.5–5.5%, by weight, Dequest 2010****;
0.7–1.5%, by weight, Polymer "G";
4.5–5.0%, by weight, Sodium Molybdate dihydrate;
0.2–0.5%, by weight, Inerts and silicone-based antifoam.

"E" A polymer containing 80:20 weight percent acrylic acid: ethyl acrylate, predominantly as the potassium salt, and having a weight average molecular weight of between about 10,000–30,000.

"F" A homopolymer of acrylic acid, as predominantly the sodium salt, having a molecular weight of about 10,000–25,000.

"G" A terpolymer of acrylic acid, methacrylic acid, and N—t-butyl acrylamide having a monomer weight ratio of about 60:20:20.

"H" A copolymer of acrylic acid and methyl acrylate, as predominantly the free acid, about 78:22 wt. %, having a molecular weight of about 8000–25,000.

"I" 67% $ZnCl_2$ solution.

"J" A terpolymer of acrylic acid, acrylamide, and acrylamido-N—methyl sulfonate, predominantly as the sodium salt, having a mole ratio of monomers of about 49, 29, 22, respectively, and a molecular weight ranging between about 5000–25,000.

*Bayhibit AM is a trademark of Mobay Chemical Co. and is PBTC.
**Cobratec TT50S is a trademark of Sherwin Williams Co. and is a solution of tolyltriazole.
***Diacid 1550 is a trademark of Westvaco and is 2-cyclohexane, 1-octanoic acid, 5(or 6)-carboxy, 4-hexyl.
****Dequest 2010 is a trademark of Monsanto Chemical Company and is HEDP.

Molecular weights are, unless indicated otherwise, weight average molecular weight.

As one can see from the above results, at pH 9.0, no formulation could adequately protect completely against dome staining during the aluminum alloy can pasteurization test process. However, from a pH of 7.0 to 8.5, the formulations containing zinc, orthophosphate, zinc stabilizing polymer, and optionally organophosphonates when used in appropriate concentrations, protected against the dome staining phenomenon. Zinc salts combined with orthophosphate, even in the presence of low molecular weight carboxylic acid complexing agents such as citric acid did not provide adequate protection.

The zinc complexing polymers by themselves, or in combination with other corrosion inhibitors, did not provide adequate protection. Zinc salts alone did not provide adequate protection against dome staining.

Having described our invention, we claim:

1. A method of preventing dome staining of aluminum beverage cans by pasteurizing said cans at temperatures from 70°–190° F. with aqueous solutions having a pH rangng from about 5.0 to 8.5 and containing:

(a) at least 1 ppm, as zinc, of a water soluble zinc salt;

(b) at least 1 ppm, as $PO^{-3}$ of an orthophosphate ion source; and (c) at least 1 ppm of a zinc ion stabilizing polymer having a molecular weight ranging from 1000–50,000 and chosen from the group consisting of:

(i) homopolymers and copolymers of acrylic acid, methacrylic acid, their water soluble salts, and mixtures thereof;

(ii) copolymers and terpolymers of acrylic acid, methacrylic acid, their water soluble salts and vinylic monomers chosen from (meth)acrylamide and N-alkylated (meth)acrylamide chosen from the group N-methyl (meth)acrylamide, N-ethyl (meth)acrylamide, and N-t-butyl (meth-)acrylamide; and (iii) terpolymers of (meth)acrylic acid, (meth)acrylamide, and an N-substituted (meth)acrylamide represented by the formula:

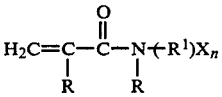

wherein $R^1$ is a hydrocarbon bridging group having from 1–12 carbon atoms and which may be linear or branched alkyl, aryl, alkaryl, arylalkyl, and mixtures thereof;

X is from the group $—SO_3M$, $—NR_2$, $—NR_3Y$, $—O\text{-}(CH_2CHRO)_m\text{-}R$, and mixtures thereof;

n is from 1–6; m is from 0–30;

M is, at each occurrence, chosen from H, Na, K, $NH_4$, and mixtures thereof;

Y is Cl, Br, $CH_3SO_4$, and mixtures thereof; and

R is, at each occurrence, chosen independently from H, $CH_3$, and $C_2H_5$.

2. The method of claim 1 wherein the aqueous solution additionally contains at least 1 ppm of an organophosphonate corrosion inhibitor.

3. A method of preventing dome staining of aluminum beverage cans by pasteurizing said cans at a temperature of from 75°–165° F. with aqueous solutions having a pH ranging from about 5.0 to 8.5 and containing:

(a) from 2–100 ppm, as zinc, of a water soluble zinc salt;

(b) from 3–200 ppm, as $PO_4^{-3}$, of a water soluble orthophosphate source;

(c) from 2–200 ppm of a water soluble zinc stabilizing polymer having a molecular weight of from 2500–25,000 and containing at least 25 weight percent (meth)acrylic acid and at least 10 weight percent of a vinylic monomer, or mixtures of vinylic monomers, chosen from the group consisting of:

(i) acrylamide and methacrylamide;

(ii) N-alkylated acrylamide and N-alkylated methacrylamide chosen from the group consisting of N-methyl (meth)acrylamide, N-ethyl (meth)acrylamide, and N-tertiary butyl (meth)acrylamide;

(iii) N-substituted (meth)acrylamides represented by:

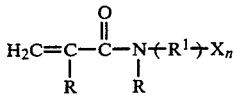

wherein:

$R^1$ is a hydrocarbon bridging group containing 1-12 carbon atoms and being linear or branched alkyl;

X is $—SO_3M$, $—O(CH_2CHRO)_mR$, and mixtures thereof;

n is from 1–4; m is from 0–20; and

M is, at each occurrence, chosen from H, Na, K, $NR_4$, and mixtures thereof; and R is, at each occurrence, chosen individually from the group H, $—CH_3$, and $C_2H_5$.

4. The method of claim 3 wherein the aqueous solution contains an additional 1–200 ppm of an organophosphonate corrosion inhibitor.

5. The method of claim 4 wherein the aqueous solution contains an additional 1 ∝ 100 ppm of a water soluble corrosion inhibitor chosen from the group consisting of substituted triazoles, diacid compounds, borax, and mixtures thereof.

6. The method of claim 3 wherein the zinc stabilizing polymer is chosen from the group consisting of:

(a) a homopolymer of acrylic acid;

(b) a copolymer of acrylic acid and ethylacrylate;

(c) a terpolymer of acrylic acid, methacrylic acid, and N-t-butyl acrylamide;

(d) a terpolymer of (meth)acrylic acid, (meth)acrylamide, and a monomer represented by:

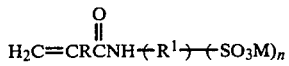

wherein:

R is chosen from H and $CH_3$;

$R^1$ is a hydrocarbon bridging group having from 1–12 carbon atoms and which is linear or branched alkyl; and M is, at each occurrence, from the group H, Na, K, $NR_4$; and n is from 1–6.

* * * * *

UNITED STATES PATENT AND TRADEMARK OFFICE

CERTIFICATE OF CORRECTION

PATENT NO. : 4,705,703

DATED : NOVEMBER 10, 1987

INVENTOR(S) : Daniel A. Meier et al.

It is certified that error appears in the above-identified patent and that said Letters Patent is hereby corrected as shown below:

Column 8, Line 17, Claim 1

(b) at least 1 ppm, as $PO^{-3}$ of an orthophosphate ion

"LETTERS PATENT SHOULD READ AS:"

(b) at least 1 ppm, as $PO_4^{-3}$ of an orthophosphate ion

Signed and Sealed this

Fifth Day of April, 1988

*Attest:*

*Attesting Officer*

DONALD J. QUIGG

*Commissioner of Patents and Trademarks*